US005170756A

United States Patent [19]

Szodfridt

[11] Patent Number: 5,170,756

[45] Date of Patent: Dec. 15, 1992

[54] ARRANGEMENT FOR CHANGING THE RELATIVE ROTATING POSITION OF SHAFTS IN AN INTERNAL-COMBUSTION ENGINE

[75] Inventor: Imre Szodfridt, Stuttgart, Fed. Rep. of Germany

[73] Assignee: Dr. Ing. h.c.F. Porsche AG, Weissach, Fed. Rep. of Germany

[21] Appl. No.: 735,005

[22] Filed: Jul. 25, 1991

[30] Foreign Application Priority Data

Jul. 28, 1990 [DE] Fed. Rep. of Germany ..... 4024056

[51] Int. Cl.[5] ..... F01L 1/34; F01L 1/04

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS

| | | | |
|---|---|---|---|
| 4,787,345 | 11/1988 | Thoma | 123/90.17 |
| 4,903,650 | 2/1990 | Ohlendorf et al. | 123/90.17 |
| 5,012,774 | 5/1991 | Strauber et al. | 123/90.17 |
| 5,058,539 | 10/1991 | Saito et al. | 123/90.17 |
| 5,067,450 | 11/1991 | Kano et al. | 123/90.17 |
| 5,088,456 | 2/1992 | Suga | 123/90.31 |

FOREIGN PATENT DOCUMENTS

| | | |
|---|---|---|
| 0245791 | 11/1987 | European Pat. Off. . |
| 0335083 | 2/1989 | European Pat. Off. . |
| 0356162 | 2/1990 | European Pat. Off. . |
| 0361980 | 4/1990 | Fed. Rep. of Germany . |
| 4029849 | 3/1991 | Fed. Rep. of Germany . |

*Primary Examiner*—E. Rollins Cross
*Assistant Examiner*—Weilun Lo
*Attorney, Agent, or Firm*—Evenson, Wands, Edwards, Lenahan and McKeown

[57] ABSTRACT

An arrangement for changing the relative rotating position of shafts in an internal-combustion engine has a camshaft, which can be rotated with respect to a shaft driving it, that has a phase converter with a piston which is acted upon hydraulically on both sides. The sprocket wheel driving the camshaft has an external toothing. A toothing, which is connected with the camshaft via a hollow shaft, is constructed as an internal toothing. Corresponding toothings of the piston engage in both toothings. In the camshaft, an axial recess is arranged in which an inserted pipe separates two spaces from one another. An on/off valve fed from the oil circulating system, in one position, via one of the spaces, supplies the piston with oil pressure so that it is axially shifted into a first end position and, in the process, turns the camshaft. In a second position, the piston is axially pushed back by the second space with oil pressure.

19 Claims, 7 Drawing Sheets

N
N
1
51
50
52
53
53
54
55
55
D3
D2
D1
64
64
60
61
61
62
4
4
5
3
3
31
18
21
20
17
12
22
16
35
63
27
26
8
24
7
F
23
25
F
14
74
13
9
11
73
19
10
15
21
18
12
35
66
65
E1

N
N
I
I
51
50
52
53
53
54
54
55
55
65
64
64
60
60
61
61
62
63
67
4
4
5
18
18
33
32
31
17
22
12
16
22
35
21
3
3
73
19
9
10
7
74
F
X
28
30
29
A
8
2

ARRANGEMENT FOR CHANGING THE RELATIVE ROTATING POSITION OF SHAFTS IN AN INTERNAL-COMBUSTION ENGINE

BACKGROUND OF THE INVENTION

The present invention relates to an arrangement for the automatically controlled changing of the relative rotating position of two shafts in an internal-combustion engine, having at least one camshaft which can be rotated as a function of parameters of the internal-combustion engine relative to a shaft driving it. The arrangement has a wheel which drives the camshaft, carries a first toothing and, by means of a coupling member which is acted upon by an oil circulating system and axially can be shifted at least in two end positions, acts upon a second toothing connected with the camshaft.

It is known to adapt the valve timing of an internal-combustion engine to its rotational speed in order to be able to optimally operate it in a rotational speed range that is as broad as possible. As a result, the torque, the performance, the exhaust gas emission, the idling characteristics and the fuel consumption can be improved.

One possibility of changing the valve timing during the operation of the internal-combustion engine consists of turning, by means of a so-called phase converter, preferably the intake camshaft in its position relative to the crankshaft which drives it. In this case, as a function of the oil pressure, a coupling member is axially shifted which is coaxially surrounded by the wheel driving the camshaft. The coupling member carries two toothings of which at least one is helical and which interact with one corresponding toothing respectively on the camshaft or in the wheel, as known, for example, from the European Patent Document EP-0 335 083.

Phase converters are known, for example, from the European Patent Document EP 0 356 162 or from the already mentioned European Patent Document EP 0 335 083, in which the wheel driving the camshaft has an internal toothing which engages in an external toothing which is assigned to the coupling member acting as a piston which is acted upon hydraulically. The piston carries a second toothing which is constructed as an internal toothing and engages into a corresponding external toothing of the camshaft. In addition, phase converters are known, for example, from the European Patent Document EP 0 245 791 in which the coupling member moved by a hydraulic piston or a solenoid has two external toothings which are axially displaced with respect to one another and of which one engages in an internal toothing of the camshaft while the other engages into an internal toothing of the driving wheel.

All of the above mentioned arrangements have the disadvantage that they require considerable additional space which increases the fitting length of an internal-combustion engine equipped with such an arrangement. Normally, a plane bounds a front-face end of the internal-combustion engine, in which case this plane is formed by the endless drive moving by way of the wheel driving the camshaft. In the known state of the art, either the device projects clearly above this end or, because of the constructional volume of the device, the wheel had to be arranged farther away from the front face of the internal-combustion engine.

It is therefore an object of the invention to avoid the above-mentioned difficulties and thus provide a compact arrangement for changing the relative rotating position of shafts in an internal-combustion engine which requires little space and therefore keeps the overall length of an internal-combustion engine equipped with such an arrangement as short as possible.

This and other objects are achieved by the present invention which provides an arrangement for automatically controlled changing of a relative rotating position of two shafts in an internal-combustion engine, comprising at least one camshaft which can be rotated as a function of parameters of the internal-combustion engine relative to a shaft driving the camshaft and having a second internal toothing. The arrangement includes an oil circulating system, a coupling member and a wheel. The coupling member has a first internal toothing and a second external toothing and is coupled to the oil circulating system so as to be axially shiftable between at least two end positions. The wheel drives the camshaft and has a first external toothing and, via the coupling member, acts upon the second internal toothing of the camshaft. The first external toothing of the wheel interacts with the first internal toothing of the coupling member, and the second internal toothing of the camshaft interacts with the second external toothing of the coupling member.

The arrangement of the present invention permits a compact construction of the phase converter and a simple design of the drive-side end of the camshaft. The compact construction is achieved by the arrangement of the two toothing pairs, which are customary in the case of a phase converter of this type, such that the wheel driving the camshaft carries a first external toothing and that a second toothing connected with the camshaft is constructed as an internal toothing, corresponding toothings of the coupling member constructed as a piston engaging in these two toothings. In this case, the toothings are all essentially coaxially enclosed by the wheel so that no additional space is required that extends in the axial direction.

In an embodiment of the invention, the second toothing is advantageously constructed not directly in the camshaft but in a hollow shaft which is detachably connected with the camshaft and which, at the same time, bounds a space with respect to the camshaft in which the piston can be axially displaced into its end positions.

The problem of axially securing the wheel is advantageously solved by the present invention in that the wheel is axially fixed on the hollow shaft without any impairment of the necessary rotational movement between the wheel and the hollow shaft when the phase converter is actuated. In this case, the wheel may be constructed as a sprocket wheel or a pulley and may be secured by a spring ring acting between the hollow shaft and the wheel or may be screwed together with the hollow shaft in such a manner that the screws, by means of guide sleeves, penetrate oblong holes arranged in the wheel.

The design of the drive-side end of the camshaft, which utilizes only already existing space, is achieved by taking the locking element, which controls the feeding and the removal of oil, out of the phase converter or the camshaft. The locking element may be arranged at any arbitrary point of the internal-combustion engine, for example, in the cylinder head and is also actuated hydraulically.

In a graduated axially extending recess of the camshaft, which is easy to manufacture, a pipe is held which separates two spaces from one another which, according to the position of the locking element, permit the feeding or the removal of oil in the camshaft or the phase converter. The spaces are connected with radial bores of the camshaft which, in turn, interact with pipes which lead into annuli of the locking element constructed as a change-over valve. The radial bores may be arranged at any arbitrary point of the camshaft.

The phase converter projects only slightly beyond the drive-side end of the camshaft and can be mounted as a complete constructional unit. When no phase converter is to be mounted, the camshaft may also be used by the fastening of a changed sprocket wheel. The camshaft, which is normally made of a hard material, requires no toothing or thread.

The arrangement requires only a small amount of oil because only the oil displaced from the chambers adjacent to the piston must be replaced for the shifting of the piston from a first end position into a second end position.

The emptying of the chambers after the switching-off of the internal-combustion engine is avoided by the fact that the oil-carrying pipes are constructed as ascending pipes which prevent an oil return flow.

The actuating circulating system for the arrangement is part of the oil circulating system of the internal-combustion engine. The lubricating circulating system for the camshafts is connected to this actuating circulating system in such a manner that, when the phase converter or the locking element fails, the lubrication is maintained.

The arrangement of the present invention is also quiet in the operation of the internal-combustion engine because there is no mechanical connection between the arrangement and a hood covering it, such as components of the arrangement which are centered in this hood.

Other objects, advantages and novel features of the present invention will become apparent from the following detailed description of the invention when considered in conjunction with the accompanying drawings.

DETAILED DESCRIPTION OF THE DRAWINGS

Figures 1, 1A:
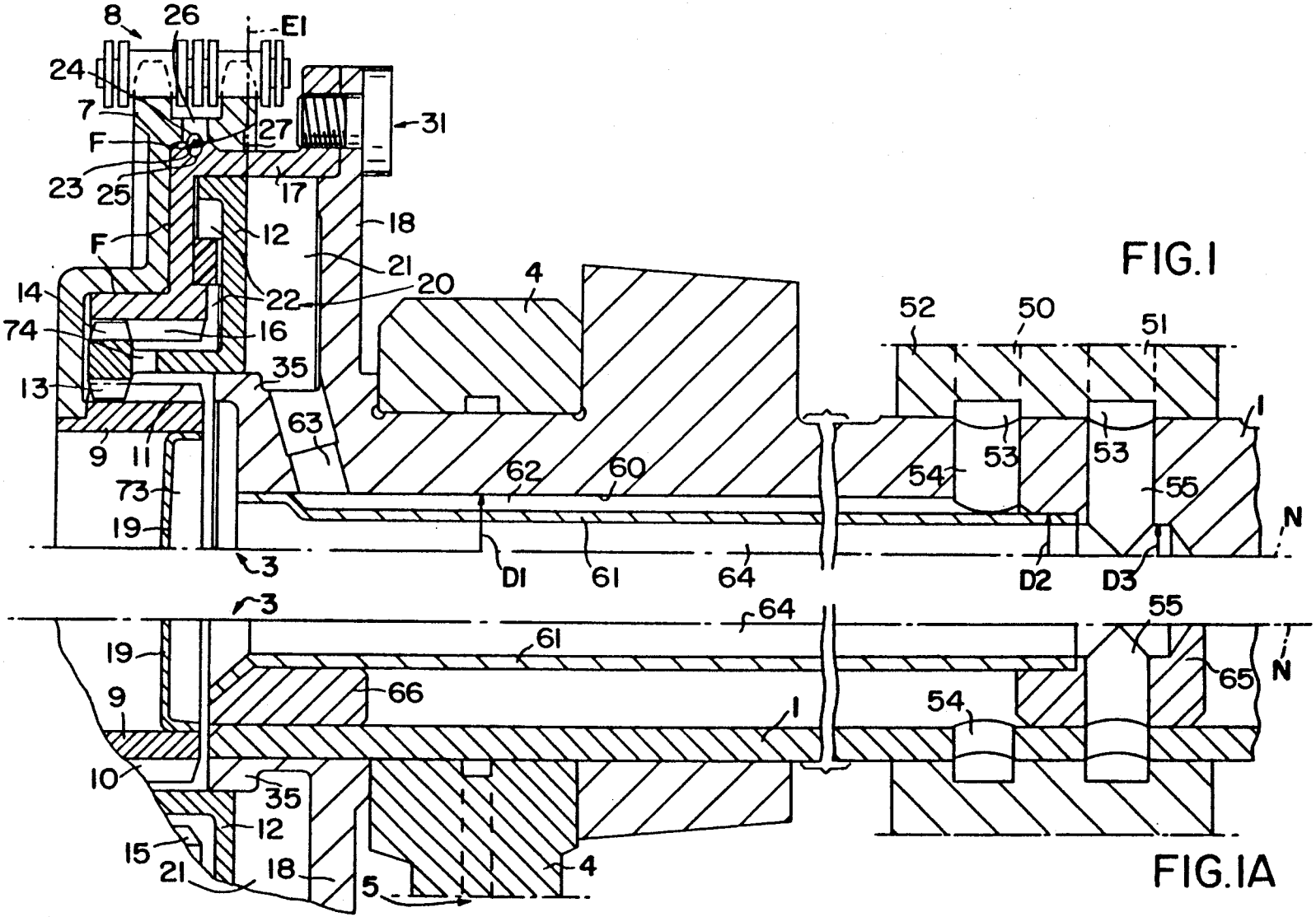
FIG. 1 is a cross-sectional view of a first embodiment of the present invention.
FIG. 1*a* is a view of the first embodiment of FIG. 1 with a modified camshaft.

In an internal-combustion engine, which is not shown in detail and which is arranged in a motor vehicle and which has four overhead camshafts, a phase converter 2 is assigned on the drive side end 3 to each of the two camshafts serving the intake. Each camshaft is held in several bearings 4 which are connected to a lubricating circulating system 5. The oil circulating system of the internal-combustion engine comprises the lubricating circulating system 5, an actuating circulating system for the adjustment of the phase converters 2 and a lubricating circulating system of a crankshaft 6 (FIG. 3) which is only schematically outlined.

Figures 2, 2A:
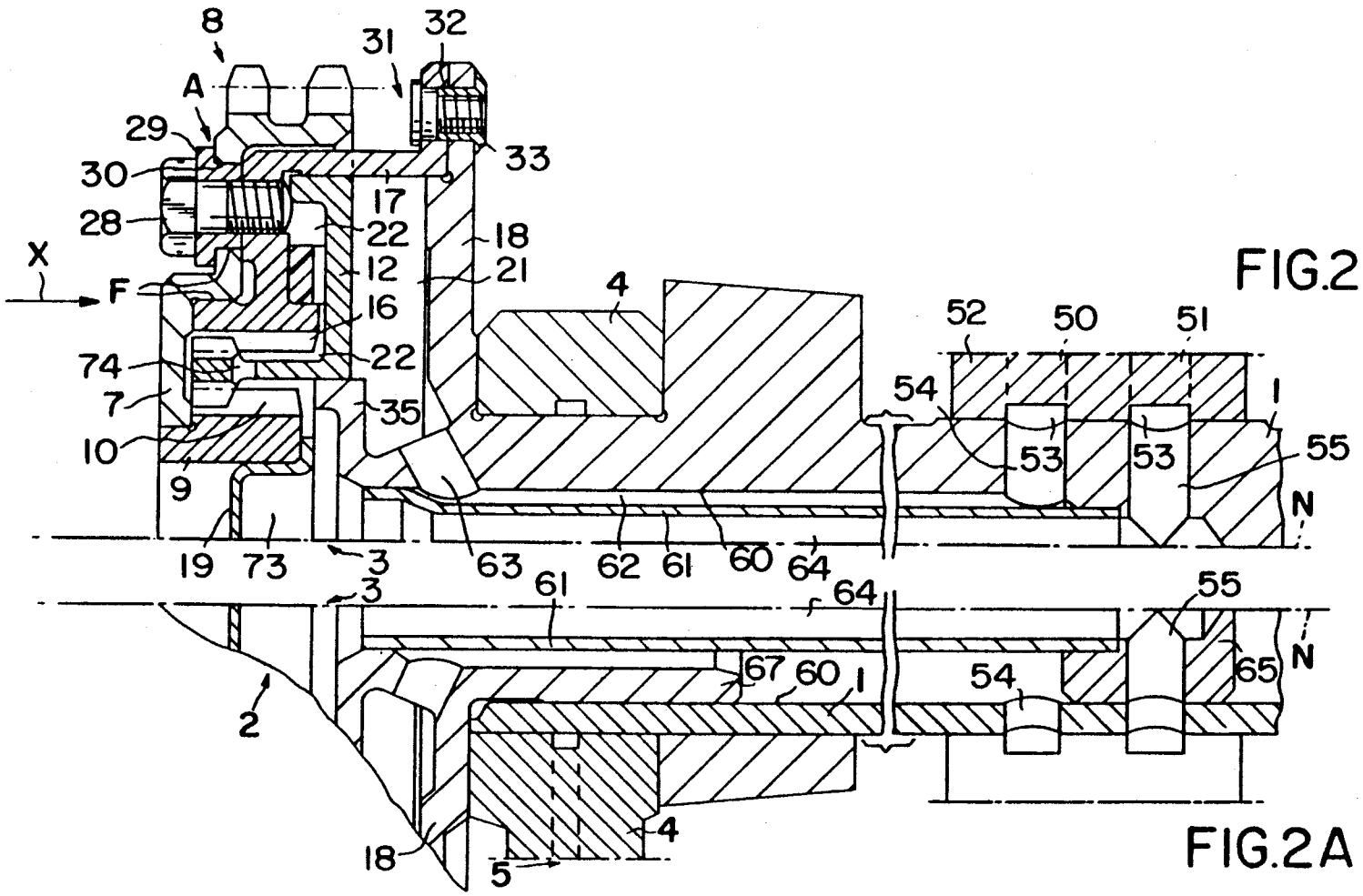
FIG. 2 is a cross-sectional view of a second embodiment of the present invention.
FIG. 2*a* is a view of the second embodiment with a modified camshaft.

The phase converter 2 comprises three normally used elements which engage with one another by way of toothings. It comprises a wheel 8 which is constructed as a sprocket wheel 7 and serves for the drive of the camshaft 1. An interior hub 9, which carries a first helical toothing 11 constructed as the first external toothing 11, is welded into the wheel 8. By way of the first toothing 11, the wheel 8 is connected, by a corresponding first helical internal toothing 13, with a coupling member constructed as a piston 12 which is hydraulically acted upon on both sides. The coupling member is axially displaceable into two end positions E1, E2 with respect to the axis N extending longitudinally and centrically in the camshaft 1 (see FIGS. 3 and 4). The piston 12 carries a second helical external toothing 14 which engages in a corresponding toothing 16 which is constructed as the second internal toothing 16 of a hollow shaft 17 connected with a flange 18 of the camshaft 1. A cap 19 is pressed into the interior hub 9. The piston 12 divides a space 20 enclosed between the flange 18 and the hollow shaft 17 into a first chamber 21 and a second chamber 22. In FIG. 1 and FIG. 2, the piston 12 is in a first end position E1 which, during the operation of the internal-combustion engine, is taken up in a first operating condition, such as idling.

In the first embodiment according to FIG. 1 and FIG. la, the sprocket wheel 7 is axially fixed on the hollow shaft 17 by means of a prestressed spring ring 23. Half of the spring ring 23 is disposed in a groove 24 of the sprocket wheel 7 and the other half is disposed in a turned groove 25 of the hollow shaft 17, the depth of which is at least twice as large as that of the groove 24. The spring ring 23 is accessible by way of several assembly openings 26.

When the wheel 8 is constructed as a pulley, sealing rings are inserted adjacent to the spring ring 23 and between the hollow shaft 17 and the flange 18.

During the mounting, the spring ring 23 is placed in the turned groove 25 into which half of it dips because of its prestressing. Subsequently, the sprocket wheel 7 is pushed onto the hollow shaft 17 in which case a molded-on slope 27 presses the spring ring 23 completely into the turned groove 25 before, when the turned groove 25 and the groove 24 cover one another, half of it is placed in this groove 24. The cross-section of the spring ring 23 may be circular or rectangular.

In a second embodiment of the arrangement according to FIGS. 2 and 2*a*, the sprocket wheel 7 is axially secured on the hollow shaft 17 by means of screws 28. These screws 28 are screwed into threads of the hollow shaft 17 and, by means of guide sleeves 29, are slidingly guided in oblong holes 30 of the sprocket wheel 7. In this case, a slight axial play A remains between the guide sleeve 29 and the wheel 8.

In both embodiments, the phase converter 2 is non-rotatably, by means of screwed connections 31, held in oblong holes 32 of the hollow shaft 17 by means of sleeve nuts 33. The oblong holes 32 permit a positionally correct mounting of the phase converter 2 irrespective of the position of the camshaft 1 which for the mounting is secured against turning.

Figure 8:
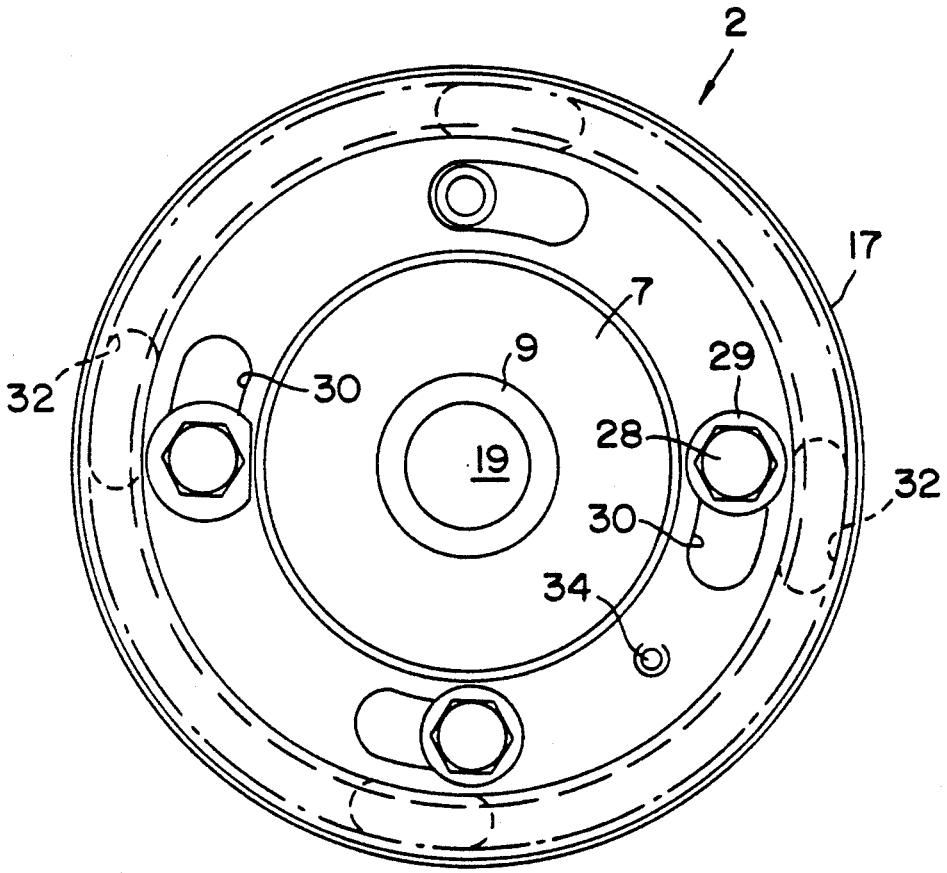
FIG. 8 is a view from the direction of the arrow X according to FIG. 2.

Before the mounting on the camshaft 1, the phase converter 2 can be completely preassembled. A pin is inserted into a fitted bore 34 (FIG. 8) penetrating the sprocket wheel and the hollow shaft 17 and secures both parts against twisting. Then, the sprocket wheel 7, as described above, is axially fixed on the hollow shaft 17 by means of a spring ring 23 or the screws 28 and the guide sleeves 29. After the pressing-in of the cap 19 and the sliding of the piston 12 into the toothings 11 and 16, the phase converter 2 is fastened to the flange 18 as a complete unit; in this case, the piston 12 is pushed onto a radial flange 35 of the camshaft 1.

Figure 3:
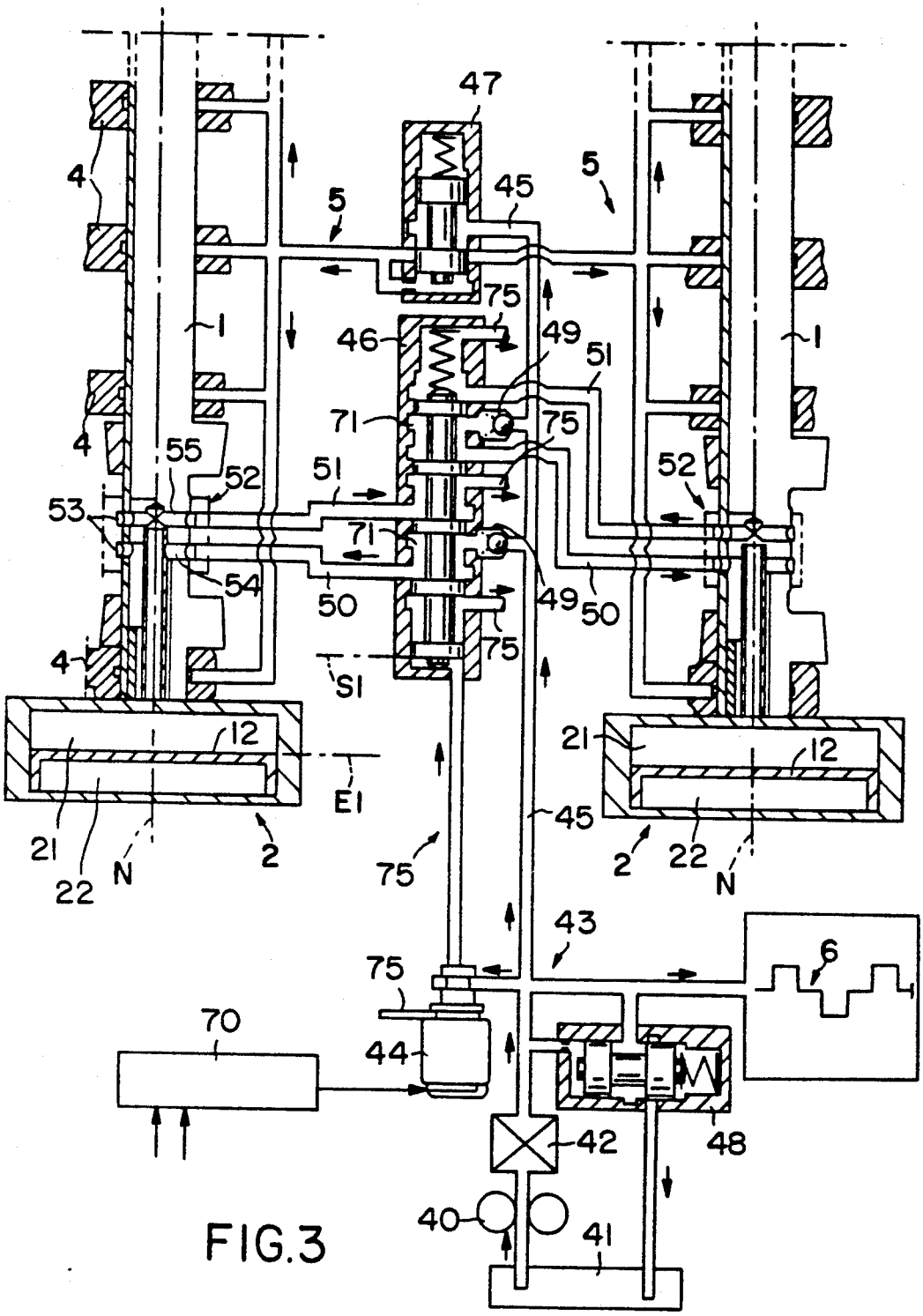
FIG. 3 is a schematic view of an oil circulating system of the arrangement of the present invention with a locking element shown in a first position.
Figure 4:
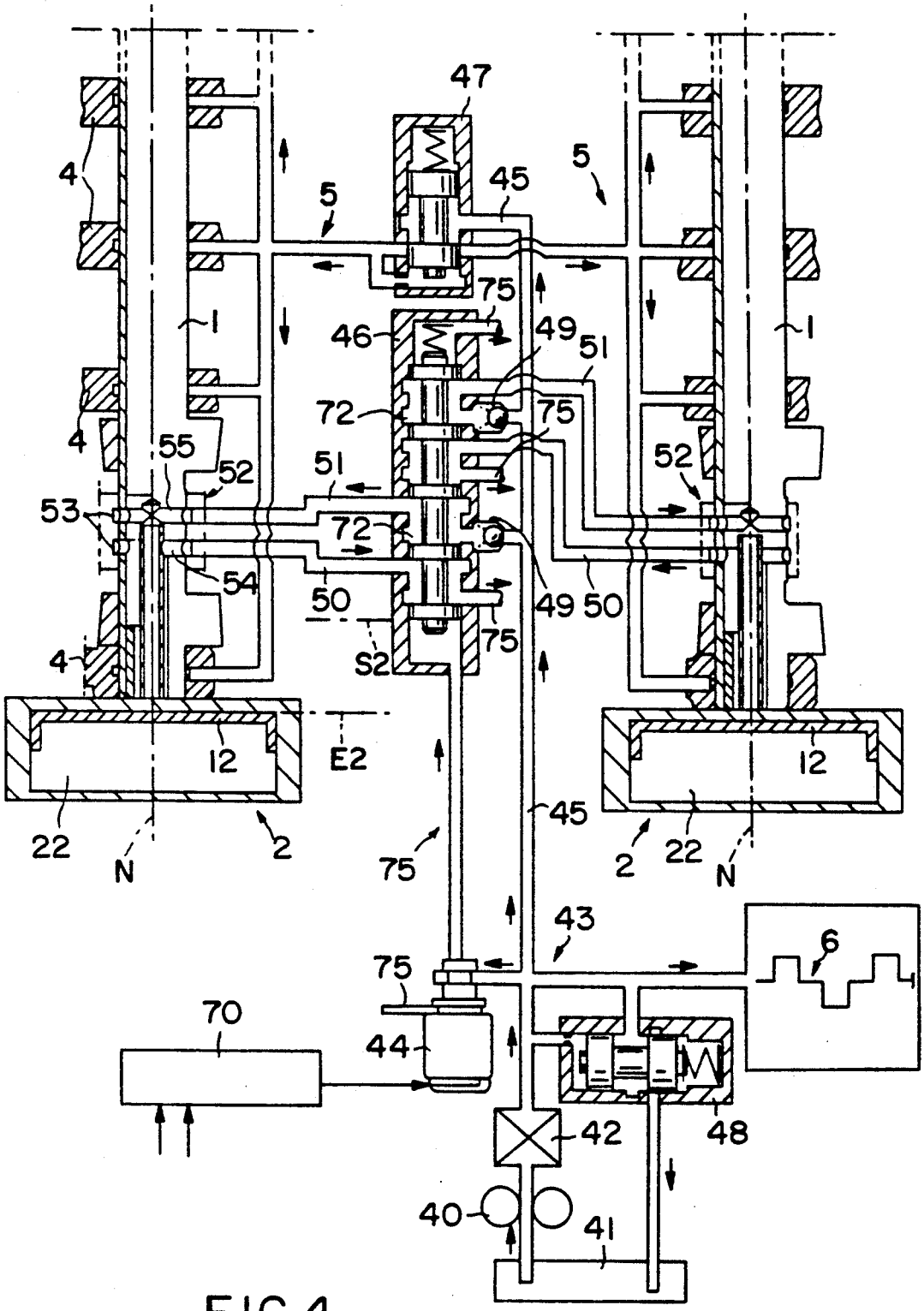
FIG. 4 is a schematic view of an oil circulating system of the arrangement of the present invention with a locking element shown in a second position.

As seen in FIGS. 3 and 4, the oil circulating system of the internal-combustion engine has a pump 40 which delivers oil from a storage tank 41 through a filter 42. From there, a junction 43 leads to an on/off valve 44, to the crankshaft 6 of the internal-combustion engine and, by way of an oil-feeding duct 45, to a change-over valve 46 (or "locking element") arranged in parallel to this duct 45 as well as a pressure reducing valve 47 situated downstream.

Between the filter 42 and the crankshaft 6, a pressure relief valve 48 is connected which limits the oil pressure delivered by the pump 40 to a maximum pressure PM.

The lubricating circulating system 5 branches off from the pressure reducing valve 47 and admits a pressure Pl to the bearings which is preferably lower than the pressure PM.

The change-over valve 46 has integrated check valves 49 by means of which the duct 45 can be coupled with the phase converters 2. A first and a second pipe 50 and 51 respectively lead from the change-over valve 46 to a separate bearing point 52 of the camshafts 1. By way of ring ducts 53 extending in these bearing points 52, a connection takes place with first and second bores 54 and 55 extending radially in the camshafts 1.

A cylindrical graduated recess 60, which extends from the end 3 rotationally symmetrically to the axis N, is provided in the camshaft 1 shown above the axis N. From the end 3 to directly behind the first bore 54, the recess 60 has a first diameter D1. Between the bores 54, 55, the recess 60 has a second smaller diameter D2, and from there to directly behind the second bore 55, a still smaller diameter D3. In the recess 60, a pipe 61 is held as a cylindrical body is radially widened at the end 3 to the diameter D1 and otherwise has the diameter D2. The pipe 61 therefore separates a ring-shaped exterior space 62 inside the recess 60 into which the first bore 54 leads and which, at the end 3, by way of an almost radially extending connecting bore 63, is connected with the first chamber 21. The second bore 55 intersects the recess 60 in the area of the diameter D3 and is connected with an interior space 64 extending inside the pipe 61.

In a modification shown in Figure 1*a*, a built-up hollow camshaft I is shown into which a bushing 65 is inserted. At the end 3, the pipe 61 is held in a clamping ring 66 as well as in the bushing 65. The flange 18 is constructed in one piece with the radial flange 35 and is pushed separately onto the camshaft 1. The second bore 55 extends partially in the bushing 65 and is, in turn, connected with the interior space 64. The exterior space 62 formed between the pipe 61 and the recess 60 connected the first bore 54 with the first chamber 21.

The modification shown in FIG. 2*a*, with respect to the bearing of the pipe 61 in the bushing 65, is identical with FIG. 1*a*, but the flange 18 is inserted into the built-up camshaft 1 in one piece with a sleeve 67.

During the operation of the internal-combustion engine, the pump 40 delivers oil from the storage tank 41 through the filter 42 to the junction 43. The on/off valve 44 is switched on or off by an electronic control unit 70 as a function of input signals of the load and rotational speed of the internal-combustion engine.

In the switched-off condition, no oil from the junction 43 reaches the change-over valve 46 by way of the on-off valve 44. The change-over valve 46, in a spring-loaded condition, is situated in a first position S1 which corresponds to the end position E1 of the piston 12. The oil, which by means of pressure is conveyed through the duct 45 along the drawn arrows, opens up the check valves 49 so that the oil flows, by way of first annuli 71, into the first pipes 50 and from there into the first bores 54. From the direction of the bore 54, the pressure acts through the exterior space 62 and the connecting bore 63, on the first chamber 21 and holds the piston 12 in its first end position E1 (FIG. 3).

In a second operating condition of the internal-combustion engine, for example, a medium rotational speed range, the control unit 70 switches on the on/off switch 44 so that, from the direction of the junction 43, oil flows by way of the on/off valve 44, to the change-over valve 46 and shifts it into a second position S2 which corresponds to the end position E2 of the piston 12 (FIG. 4). The oil, which by way of the check valves 49, flows into second annuli 72, will now, by way of the second pipes 51, reach the second bores 55. From there, the pressure acts, through the interior space 64, on the second chamber 22. In this case, the oil flows from the open end of the pipe 61, into a hollow space 73 formed by the radial flange 35 and the cap 19 and; from there, by way of openings 74 in the piston 12, into the second chamber 22. In this case, this piston 12 is axially displaced into the second end position E2, in which case, by way of the helical toothings 11, 13 and 14, 16, the sprocket wheel 7 is turned relative to the camshaft 1. In this case, rotational displacements occur in the phase converters 2 between the components bordering on sliding surfaces F.

The oil volume, which was displaced from the first chamber 21 during the shifting from the end position E1 into the end position E2, flows by way of the connecting bore 63, the exterior space 62 and the first bore 54, into the ring duct 53 and from there flows off by way of the first pipe 50.

In the two end positions E1, E2 of the change-over valve 46, the annuli 71, 72, which receive oil flowing back from the phase converters 2, are connected with ascending pipes 75 which geodetically lead out above the phase converters 2 in the internal-combustion engine so that, after the switching-off of the internal-combustion engine, an emptying of the actuating circulating system is avoided.

During the adjustment of the piston 12 from the end position E2 into the end position E1, the oil displaced from the second chamber 22, through the openings 74, the hollow space 73, the interior space 64 and the second bore 55, flows into the ring duct 53 and from there, by way of a second pipe 51, into the change-over valve 46.

During an operation of the internal-combustion engine at low rotational speeds, the pump 40 does not deliver a maximal pressure PM. If, in this case, a shifting of the piston 12 should nevertheless be necessary, the check valves 49 cause a gradual filling of the annuli 71, 72. As a result, the piston 12 is shifted from one end position into the other in a graduated manner.

Instead of the change-over valve 46 being assigned to two camshafts one separate actuating circulating system respectively may be assigned to the two camshafts 1. In this case, a duct 45, a change-over valve 46 with a check valve 49 as well as a pressure reducing valve 47 are assigned to each camshaft 1.

Figure 5:
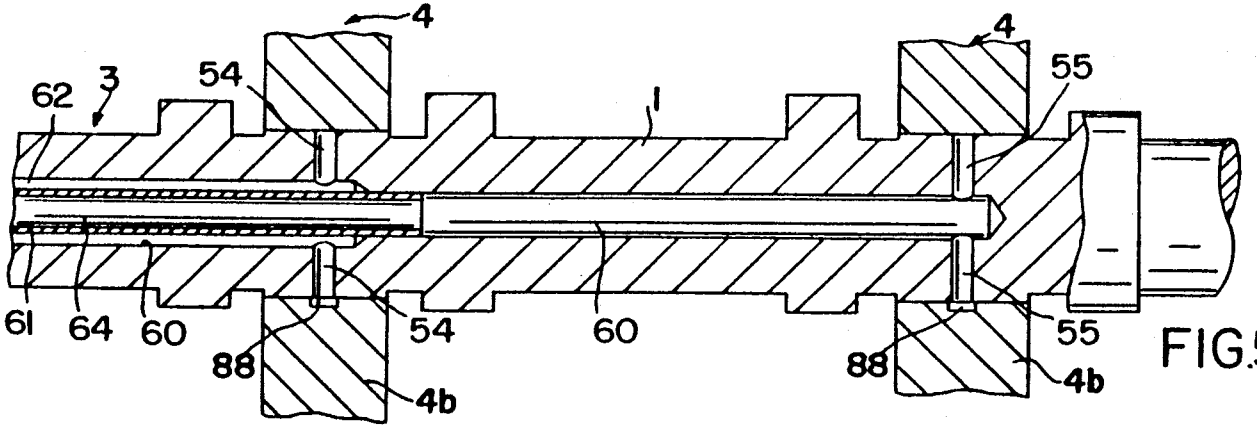
FIG. 5 is a view of the camshaft of a third embodiment of the present invention.

In a third embodiment of the invention according to FIG. 5, no separate bearing point 52 is required in order to ensure the feeding and removal of oil in the camshaft 1. The radial first and second bores 54, 55 are arranged at points of the camshaft 1 that are supported in the bearings 4

Figure 7:
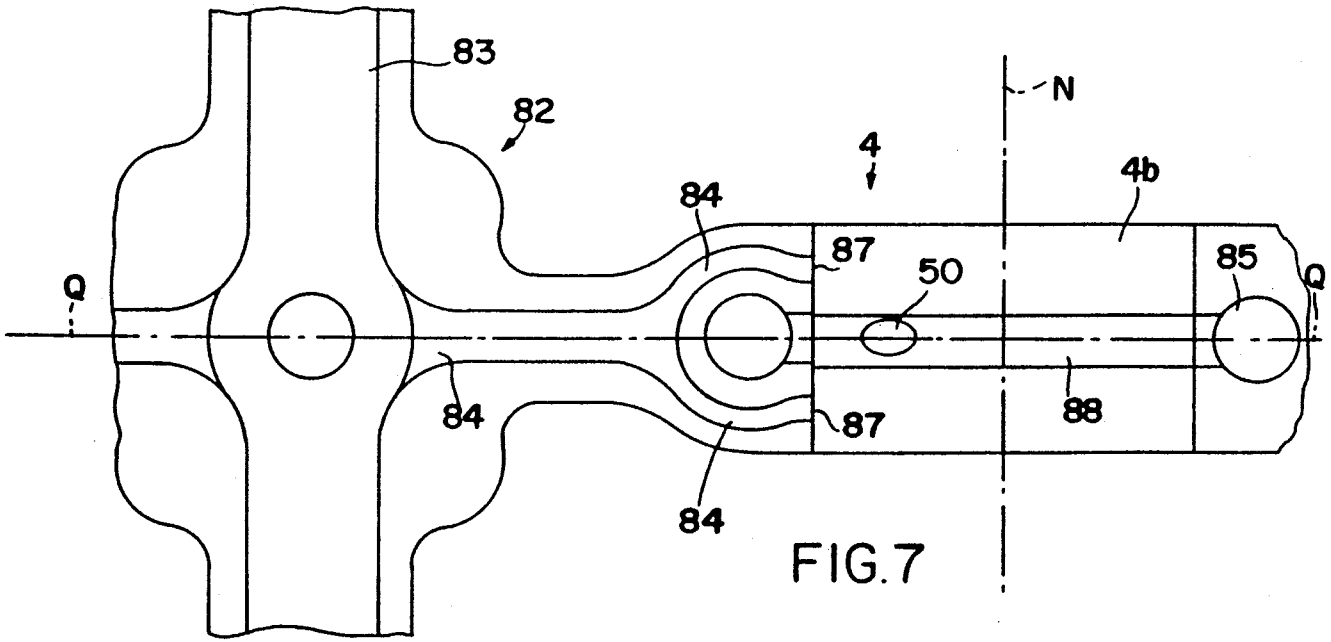
FIG. 7 is a sectional view along Line VII—VII according to FIG. 6.
Figure 6:
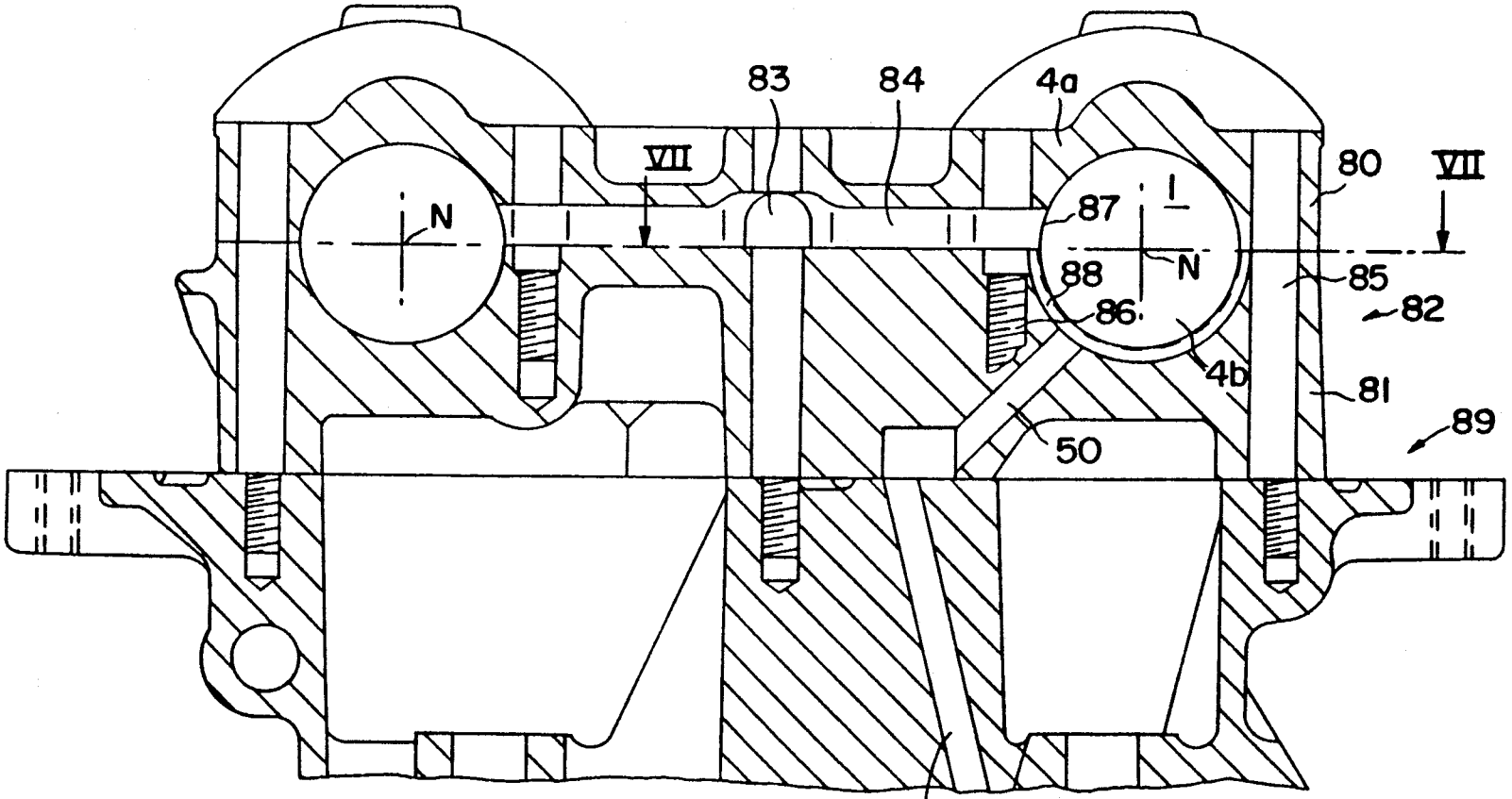
FIG. 6 is a cross-sectional view of a cylinder head of an internal-combustion engine with the third embodiment of the present invention.

The bearings 4 are, in each case, constructed as an upper and a lower half 4*a*, 4*b* in a top part 80 and a bottom part 81 of a bearing frame 82 for camshafts (FIGS. 6 and 7). In the top part 80, ducts 83, 84 extend as part of the lubricating circulating system 5. From the duct 83, which is situated downstream of the pressure reducing valve 47 and extends in parallel to the axis N in the top part 80, ducts 84 branch off rectangularly in a transverse plane Q to each bearing 4. Bores 85 receive screwed connections 86 for the fastening of the top part 80 on the bottom part 81. The ducts 84 are guided in a ring-shaped manner around the bores 85 situated between the axis N and the duct 83 so that the oil with the pressure P1 adjacent to the transverse plane Q, by way of two lubricating openings 87, supplies the bearing 4 in its upper half 4*a*.

The supplying of the exterior space 62 and the interior space 64 takes place analogously to the first two embodiments of the invention, but the pipe 50 leading to the first bore 54 is arranged in a first bearing 4, and the pipe 51 leading to the second bore 55 is arranged in a second bearing which is adjacent to the first bearing 4. The lower halves 4*b* each have a groove 88 which according to FIG. 7 is arranged symmetrically with respect to the transverse plane Q between the lubricating openings 87. The first pipe 50 leads into this groove 88, and the second pipe 51 leads into the groove 88 of a second bearing 4.

According to FIG. 6, the bearing frame 82 is fastened to the side of a cylinder head 89 facing away from the combustion spaces in which some of the pipes 50, 51 of the actuating circulating system are arranged.

By means of the above-described embodiment, the parts of the lubricating circulating system 5 and of the actuating circulating system, which are arranged in a bearing 4, and thus also the different oil pressures P1, PM are separated from one another. Also in this embodiment, the camshaft 1 can be used in the modified form according to FIGS. 1*a* and 2*a*. In this case, the length of the bushing 65 is constructed corresponding to the distance between two adjacent bearings 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for automatically controlled changing of a relative rotating position of two shafts in an internal-combustion engine, comprising:

at least one camshaft which can be rotated as a function of parameters of the internal-combustion engine relative to a shaft driving the camshaft and having a second internal toothing;

an oil circulating system;

a coupling member having a first internal toothing and a second external toothing and which is coupled to the oil circulating system so as to be axially shiftable between at least two end positions;

a wheel which drives the camshaft and having a first external toothing and which, via the coupling member, acts upon the second internal toothing of the camshaft, wherein the first external toothing of the wheel interacts with the first internal toothing of the coupling member, and the second internal toothing of the camshaft interacts with the second external toothing of the coupling member;

further comprising a hollow shaft which is detachably connected with the camshaft, said second toothing being received within the hollow shaft;

further comprising screwed connections, and wherein the hollow shaft has oblong holes and in a non-rotatable manner is fastened to the camshaft via penetration of the screwed connections into the oblong holes.

2. An arrangement for automatically controlled changing of a relative rotating position of two shafts in an internal-combustion engine, comprising:

at least one camshaft which can be rotated as a function of parameters of the internal-combustion engine relative to a shaft driving the camshaft and having a second internal toothing;

an oil circulating system;

a coupling member having a first internal toothing and a second external toothing and which is coupled to the oil circulating system so as to be axially shiftable between at least two end positions;

a wheel which drives the camshaft and having a first external toothing and which, via the coupling member, acts upon the second internal toothing of the camshaft, wherein the first external toothing of the wheel interacts with the first internal toothing of the coupling member, and the second internal toothing of the camshaft interacts with the second external toothing of the coupling member;

further comprising a hollow shaft which is detachably connected with the camshaft, said second toothing being received within the hollow shaft;

wherein the wheel is axially held on the hollow shaft;

further comprising a radially prestressed spring ring that axially holds the wheel on the hollow shaft.

3. An arrangement according to claim 2, wherein the wheel has a groove and the hollow shaft has a turned groove, and wherein half of the spring ring is arranged in the groove of the wheel and the other half of the spring ring is arranged in the turned groove of the hollow shaft.

4. An arrangement for automatically controlled changing of a relative rotating position of two shafts in an internal-combustion engine, comprising:

at least one camshaft which can be rotated as a function of parameters of the internal-combustion engine relative to a shaft driving the camshaft and having a second internal toothing;

an oil circulating system;

a coupling member having a first internal toothing and a second external toothing and which is coupled to the oil circulating system as to be axially shiftable between at least two end positions;

a wheel which drives the camshaft and having a first external toothing and which, via the coupling member, acts upon the second internal toothing of the camshaft, wherein the first external toothing of the wheel interacts with the first internal toothing of the coupling member, and the second internal toothing of the camshaft interacts with the second external toothing of the coupling member;

further comprising a hollow shaft which is detachably connected with the camshaft, said second toothing being received within the hollow shaft; and further comprising a space between the camshaft and the hollow shaft, wherein said coupling member divides the space into two chambers fluidly coupled to the oil circulating system.

5. An arrangement according to claim 4, wherein the wheel is axially held on the hollow shaft.

6. An arrangement according to claim 4, wherein the wheel has oblong holes, and the wheel is axially fastened on the hollow shaft by screws that penetrate the oblong holes through guide sleeves.

7. An arrangement according to claim 6, wherein a slight axial play exists between the guide sleeves and the wheel.

8. An arrangement according to claim 4, further comprising an axial recess arranged in the end of the camshaft adjacent to the hollow shaft, the recess being connected with the oil circulating system, and having a locking element which controls filling and emptying of the chambers with oil, and a cylindrical body arranged in the recess separates a ring-shaped exterior space which, in a first position of the change-over valve connects the first chamber during filling with a first bore of the camshaft connected to the oil circulating system.

9. An arrangement according to claim 8 wherein in a second position of the change-over valve, the first chamber during emptying is connected with the first bore.

10. An arrangement according to claim 9, wherein in the first and second positions, the second chamber, by means of an interior space enclosed by the pipe, is connected with a second bore of the camshaft connected to the oil circulating system.

11. An arrangement according to claim 10, wherein the change-over valve is arranged in parallel to the oil-carrying duct of the oil circulating system and has annuli which, in the first and second positions are connected by first and second pipes to the first and second bores.

12. An arrangement according to claim 11, further comprising check valves between the oil-carrying duct and the annuli.

13. An arrangement according to claim 12, further comprising a lubricating circulating system, and wherein the duct leads downstream of the change-over valve into a pressure reducing valve which, via the lubricating circulating system of the crankshaft of the internal-combustion engine, is connected with bearings of the camshaft.

14. An arrangement according to claim 13 wherein the duct downstream of the change-over valve has a junction which is connected with a pump, the change-over valve, an on/off valve, and the lubricating circulating system.

15. An arrangement according to claim 14, further comprising a control unit, and wherein the on/off valve, as a function of input signals of the control unit, shifts the change-over valve between the first and second positions.

16. An arrangement according to claim 10, wherein the recess has a first diameter from the end along an axis to behind the first bore, has a smaller second diameter between the first and second bores, and has a still smaller, third diameter from between the first and second bores to behind the second bore.

17. An arrangement according to claim 10 wherein the first and second bores are arranged inside a separate bearing point of the camshaft.

18. An arrangement according to claim 10, wherein the first bore leads into a groove of a first bearing of the camshaft and in that the second bore leads into a groove of a second bearing situated adjacent to the first bearing.

19. An arrangement for automatically controlled changing of a relative rotating position of two shafts in an internal-combustion engine, comprising:

at least one camshaft which can be rotated as a function of parameters of the internal-combustion engine relative to a shaft driving the camshaft and having a second internal toothing;

an oil circulating system;

a coupling member having a first internal toothing and a second external toothing and which is coupled to the oil circulating system so as to be axially shiftable between at least two end positions;

a wheel which drives the camshaft and having a first external toothing and which, via the coupling member, acts upon the second internal toothing of the camshaft, wherein the first external toothing of the wheel interacts with the first internal toothing of the coupling member, and the second internal toothing of the camshaft interacts with the second external toothing of the coupling member;

further comprising at least two camshafts, wherein a change-over valve with a check valve and a duct with a pressure reducing valve is assigned to each camshaft.

* * * * *